US011346312B2

(12) United States Patent
Sato et al.

(10) Patent No.: US 11,346,312 B2
(45) Date of Patent: May 31, 2022

(54) DAMPER UNIT

(71) Applicant: EAGLE INDUSTRY CO., LTD., Tokyo (JP)

(72) Inventors: Yusuke Sato, Tokyo (JP); Toshiaki Iwa, Tokyo (JP); Yoshihiro Ogawa, Tokyo (JP)

(73) Assignee: EAGLE INDUSTRY CO., LTD.

( * ) Notice: Subject to any disclaimer, the term of this patent is extended or adjusted under 35 U.S.C. 154(b) by 0 days.

(21) Appl. No.: 17/048,568

(22) PCT Filed: May 17, 2019

(86) PCT No.: PCT/JP2019/019619
§ 371 (c)(1),
(2) Date: Oct. 16, 2020

(87) PCT Pub. No.: WO2019/221261
PCT Pub. Date: Nov. 21, 2019

(65) Prior Publication Data

US 2021/0164430 A1 Jun. 3, 2021

(30) Foreign Application Priority Data

May 18, 2018 (JP) ..... JP2018-096190

(51) Int. Cl.
*F02M 55/04* (2006.01)

(52) U.S. Cl.
CPC ..... *F02M 55/04* (2013.01); *F02M 2200/315* (2013.01)

(58) Field of Classification Search
CPC ..... F02M 55/04; F02M 2200/315
USPC ..... 138/30
See application file for complete search history.

(56) References Cited

U.S. PATENT DOCUMENTS

| | | | | |
|---|---|---|---|---|
| 3,020,928 | A | 2/1962 | William | 138/30 |
| 4,728,085 | A | 3/1988 | Bebermeier | 267/122 |
| 5,743,170 | A | 4/1998 | Pascual et al. | 92/103 |
| 7,004,733 | B2 | 2/2006 | Schepp | B60T 8/4031 |
| 8,366,421 | B2 | 2/2013 | Munakata | 417/540 |
| 8,562,315 | B2 | 10/2013 | Inoue | 417/540 |
| 8,727,752 | B2 | 5/2014 | Lucas | 417/541 |

(Continued)

FOREIGN PATENT DOCUMENTS

| | | | |
|---|---|---|---|
| CN | 1219993 | 6/1999 | F01B 19/00 |
| CN | 103097716 | 5/2013 | F02M 59/44 |

(Continued)

OTHER PUBLICATIONS

International Preliminary Report on Patentability issued in PCT/JP2019/019619, dated Nov. 24, 2020, with English translation, 10 pages.

(Continued)

*Primary Examiner* — Craig M Schneider
*Assistant Examiner* — David R Deal
(74) *Attorney, Agent, or Firm* — Hayes Soloway P.C.

(57) ABSTRACT

There is provided a damper unit that allows a plurality of damper bodies to be installed by simple work. The damper unit includes at least two damper bodies that are installed in a housing space so as to be stacked and include hermetically sealed spaces therein. The damper unit further an elastic member 7 that is disposed between the damper bodies, and a stopper that is installed across outer peripheral edge portions of the damper bodies positioned at both ends.

19 Claims, 8 Drawing Sheets

(56) References Cited

U.S. PATENT DOCUMENTS

| | | | | |
|---|---|---|---|---|
| 8,757,212 | B2 | 6/2014 | Bartsch | 138/30 |
| 8,955,550 | B2 | 2/2015 | Oikawa | 138/30 |
| 9,057,348 | B2 | 2/2015 | Usui | F02M 55/04 |
| 9,803,600 | B2 | 10/2017 | Nah | F02M 37/0041 |
| 9,828,988 | B2 | 11/2017 | Koehler | F02M 59/44 |
| 10,480,466 | B2 | 11/2019 | Tomitsuka et al. | F02M 37/0041 |
| 10,480,704 | B2 | 11/2019 | Yoshida | F02M 55/00 |
| 10,544,768 | B2 | 1/2020 | Kashiwagi | F02M 59/44 |
| 10,718,296 | B2 | 6/2020 | Hayatani et al. | |
| 10,753,331 | B2 | 8/2020 | Iwa | F16F 1/048 |
| 2002/0153209 | A1 | 10/2002 | Nagy | F16F 9/04 |
| 2003/0164161 | A1 | 9/2003 | Usui | F02M 59/366 |
| 2005/0019188 | A1 | 1/2005 | Usui et al. | F04B 11/00 |
| 2006/0071381 | A1 | 4/2006 | Hatakeyama | 26/140.13 |
| 2006/0272144 | A1 | 12/2006 | Matsuki | B23K 26/125 |
| 2007/0079810 | A1 | 4/2007 | Usui | F02M 63/028 |
| 2008/0175735 | A1 | 7/2008 | Lucas | F02M 37/0041 |
| 2008/0289713 | A1 | 11/2008 | Munakata et al. | 138/26 |
| 2009/0288639 | A1 | 11/2009 | Usui et al. | 123/457 |
| 2010/0209274 | A1 | 8/2010 | Oikawa | F04B 53/004 |
| 2010/0215529 | A1 | 8/2010 | Inoue | F04B 53/002 |
| 2011/0103985 | A1 | 5/2011 | Mancini et al. | F04B 11/00 |
| 2011/0108007 | A1 | 5/2011 | Manchini | F04B 1/0448 |
| 2011/0110807 | A1 | 5/2011 | Kobayashi | F04B 1/0452 |
| 2011/0110808 | A1 | 5/2011 | Inoue | F04B 11/0033 |
| 2011/0209687 | A1 | 9/2011 | Schroeder et al. | F02M 69/00 |
| 2011/0247488 | A1 | 10/2011 | Oikawa | F02M 59/44 |
| 2012/0006303 | A1 | 1/2012 | Usui | F02M 59/44 |
| 2012/0087817 | A1 | 4/2012 | Lucas | F04B 1/0404 |
| 2012/0195780 | A1 | 8/2012 | Matsumoto | F02M 59/02 |
| 2013/0001842 | A1 | 1/2013 | Kanaya | 267/140.13 |
| 2013/0052064 | A1 | 2/2013 | Oikawa | F04B 11/0016 |
| 2013/0209289 | A1 | 8/2013 | Lucas | F04B 43/02 |
| 2013/0230417 | A1 | 9/2013 | Kobayashi | F16L 55/0338 |
| 2013/0276929 | A1 | 10/2013 | Oikawa | F02M 59/102 |
| 2014/0193280 | A1 | 7/2014 | Saito | F04B 11/00 |
| 2014/0216418 | A1 | 8/2014 | Asayama | F02M 69/02 |
| 2015/0017040 | A1 | 1/2015 | Hishinuma | F02M 55/04 |
| 2015/0132165 | A1 | 5/2015 | Inoue | F02M 37/043 |
| 2015/0260133 | A1 | 9/2015 | Iwa | 92/47 |
| 2015/0260182 | A1 | 9/2015 | Kobayshi | F04B 43/02 |
| 2016/0169173 | A1 | 6/2016 | Yabuuchi | F02M 59/44 |
| 2016/0195084 | A1 | 7/2016 | Koehler | F02M 55/04 |
| 2016/0298581 | A1 | 10/2016 | Nah et al. | F02M 37/0041 |
| 2017/0276130 | A1 | 9/2017 | Usui et al. | F04B 53/14 |
| 2017/0335810 | A1 | 11/2017 | Tomitsuka et al. | G02M 37/0041 |
| 2017/0350354 | A1 | 12/2017 | Ostrosky et al. | G02M 37/00 |
| 2018/0171992 | A1 | 6/2018 | Saito | F02M 59/44 |
| 2018/0195478 | A1 | 7/2018 | Iwa | F16F 1/06 |
| 2018/0202401 | A1 | 7/2018 | Iwa et al. | F02M 55/04 |
| 2018/0209389 | A1 | 7/2018 | Iwa | F16L 55/054 |
| 2018/0223782 | A1 | 8/2018 | Yabuuchi et al. | F02M 55/04 |
| 2018/0274525 | A1 | 9/2018 | Schretling | F04B 11/00 |
| 2018/0306368 | A1 | 10/2018 | Yoshida et al. | F16L 55/053 |
| 2018/0328322 | A1 | 11/2018 | Kashiwagi | F02M 37/0041 |
| 2019/0024646 | A1 | 1/2019 | Kurt | F04B 11/0033 |
| 2019/0048837 | A1 | 2/2019 | Mikhaylov | F04B 53/16 |
| 2019/0063388 | A1 | 2/2019 | Kurt | F02M 55/04 |
| 2019/0152455 | A1 | 5/2019 | Kai | B60T 17/00 |
| 2019/0285032 | A1 | 9/2019 | Mikhaylov | F04B 53/16 |
| 2021/0164430 | A1 | 6/2021 | Sata | G02M 59/44 |
| 2021/0215127 | A1 | 7/2021 | Kashiwagi | F04B 35/01 |
| 2021/0239080 | A1 | 8/2021 | Sato | F02M 59/36 |
| 2021/0246860 | A1 | 8/2021 | Iwa | G02M 59/48 |
| 2021/0285589 | A1 | 9/2021 | Iwa | F04B 11/003 |

FOREIGN PATENT DOCUMENTS

| | | | |
|---|---|---|---|
| CN | 104066968 | 9/2014 | F02M 59/34 |
| CN | 107002615 | 8/2017 | F02N 59/44 |
| CN | 107429642 | 12/2017 | F02M 33/00 |
| DE | 10 2014 219 997 | 4/2016 | F04B 11/00 |
| DE | 10 2015 219 537 | 4/2017 | F04B 11/00 |
| DE | 10 2015 219 768 | 4/2017 | F02M 55/04 |
| DE | 10 2015 223 159 | 6/2017 | F02M 37/00 |
| DE | 10 2016 203 217 | 8/2017 | F02M 55/04 |
| DE | 10 2016 205 428 | 10/2017 | F04B 11/00 |
| JP | 10-299609 | 11/1998 | F02M 55/00 |
| JP | 2005-42554 | 2/2005 | F02M 59/44 |
| JP | 2007-218264 | 8/2007 | F02M 55/00 |
| JP | 2008-14319 | 1/2008 | F02M 59/44 |
| JP | 2009-264239 | 11/2009 | F02M 59/44 |
| JP | 2012-197732 | 10/2012 | F02M 59/44 |
| JP | 2013-64364 | 4/2013 | F02M 59/44 |
| JP | 2014-190188 | 10/2014 | F02M 55/02 |
| JP | 2015-017585 | 1/2015 | |
| JP | 2015-017621 | 1/2015 | |
| JP | 2015-232283 | 12/2015 | F02M 55/00 |
| JP | 2016-113922 | 6/2016 | F02M 59/44 |
| JP | 2017-32069 | 2/2017 | F16F 9/04 |
| JP | 2018-71443 | 5/2018 | F02M 59/44 |
| KR | 10-2012-0090452 | 8/2012 | F02M 59/14 |
| WO | WO 2016/190096 | 1/2016 | F02M 59/44 |
| WO | WO 2017/022604 | 2/2017 | F16F 9/04 |
| WO | WO 2017022603 | 2/2017 | B23K 26/28 |
| WO | WO 2017167499 | 10/2017 | B23K 26/28 |
| WO | WO2017195415 | 11/2017 | |
| WO | WO2018056109 | 3/2018 | F02M 55/04 |

OTHER PUBLICATIONS

International Search Report and Written Opinion issued in PCT/JP2019/019619, dated Aug. 13, 2019, with English translation, 18 pages.

International Preliminary Report on Patentability issued in PCT/JP2019/019618, dated Nov. 24, 2020, with English translation, 10 pages.

International Search Report and Written Opinion issued in PCT/JP2019/019618, dated Jun. 25, 2019, with English translation, 19 pages.

International Preliminary Report on Patentability issued in PCT/JP2019/019616, dated Nov. 24, 2020, with English translation, 6 pages.

International Search Report and Written Opinion issued in PCT/JP2019/019616, dated Jul. 9, 2019, with English translation, 11 pages.

International Preliminary Report on Patentability issued in PCT/JP2019/020195, dated Dec. 1, 2020, with English translation, 7 pages.

International Search Report and Written Opinion issued in PCT/JP2019/020195, dated Jul. 30, 2019, with English translation, 12 pages.

International Preliminary Report on Patentability issued in PCT/JP2019/019615, dated Nov. 24, 2020, with English translation, 7 pages.

International Search Report and Written Opinion issued in PCT/JP2019/019615, dated Aug. 13, 2019, with English translation, 15 pages.

Official Action dated Oct. 1, 2021, issued in related U.S. Appl. No. 17/048,568, 8 pages.

Official Action dated Sep. 21, 2021, issued in related U.S. Appl. No. 17/048,980, 19 pages.

Notice of Allowance dated Sep. 21, 2021, issued in related U.S. Appl. No. 17/762,111, 9 pages.

Notice of Allowance dated Oct. 19, 2021, issued in related U.S. Appl. No. 17/048,992, 7 pages.

Notice of Allowance dated Oct. 27, 2021, issued in related U.S. Appl. No. 17/050,422, 14 pages.

Notice of Allowance dated Nov. 24, 2021, issued in related U.S. Appl. No. 17/052,168, 8 pages.

Official Action dated Jun. 24, 2021, issued in related U.S. Appl. No. 17/762,111, 21 pages.

Official Action dated Apr. 1, 2021, issued in related U.S. Appl. No. 17/762,111, 20 pages.

(56) References Cited

OTHER PUBLICATIONS

"Development of Optimal diaphragm-based pulsation damper structure for high-pressure GDI pump systems through design of experiments", NPL Scientific Journal Publication; retrieved Sep. 2, 2021, https://www.sciencedirect.com/science/article/pii/S0957415813000238 (Year 2013).
International Preliminary Report on Patentability issued in PCT/JP2018/042765, dated May 26, 2020, 5 pages.
International Search Report and Written Opinion issued in PCT/JP2018/042765, dated Feb. 12, 2019, with English translation, 15 pages.
Supplemental European Search Report issued in corresponding European Patent Application No. 18882045.0, dated Jun. 15, 2021, 7 pages.
Chinese Official Action issued in related Chinese Patent Application Serial No. 201880073747.6, dated Jun. 1, 2021 (17 pages).
Chinese Official Action issued in related Chinese Patent Application Serial No. 201980025963.8, dated Sep. 28, 2021 (13 pages).
Chinese Official Action issued in related Chinese Patent Application Serial No. 201980026782.7, dated Oct. 9, 2021 (11 pages).
Chinese Official Action issued in related Chinese Patent Application Serial No. 201980026783.7, dated Oct. 9, 2021 (13 pages).
Chinese Official Action issued in related Chinese Patent Application Serial No. 201980029574.2, dated Oct. 11, 2021 (12 pages).
Chinese Official Action issued in related Chinese Patent Application Serial No. 201980029484.3, dated Oct. 11, 2021 (13 pages).
Korean Official Action issued in related Korean Patent Application Serial No. 10-2020-7030274, dated Oct. 21, 2021 with translation (9 pages).
Official Action dated Jun. 18, 2021, issued in related U.S. Appl. No. 17/050,422, 15 pages.
Official Action dated Aug. 26, 2021, issued in related U.S. Appl. No. 17/052,168, 29 pages.

DAMPER UNIT

TECHNICAL FIELD

The present invention relates to a damper unit that absorbs pulsation generated when liquid is sent by a pump or the like.

BACKGROUND ART

For example, when an engine or the like is to be driven, a high-pressure fuel pump is used to pump fuel, which is supplied from a fuel tank, to an injector. The high-pressure fuel pump pressurizes and discharges fuel by the reciprocation of a plunger that is driven by the rotation of a cam shaft of an internal-combustion engine.

As a mechanism for pressurizing and discharging fuel in the high-pressure fuel pump, an intake stroke for opening an intake valve and taking in fuel to a pressurizing chamber from a fuel chamber formed on a fuel inlet side, when the plunger is moved down, is performed first. Then, an amount adjustment stroke for returning a part of the fuel of the pressurizing chamber to the fuel chamber, when the plunger is moved up, is performed, and a pressurization stroke for pressurizing fuel, when the plunger is further moved up after the intake valve is closed, is performed. As described above, the high-pressure fuel pump repeats a cycle that includes the intake stroke, the amount adjustment stroke, and the pressurization stroke, to pressurize fuel and to discharge the fuel toward the injector. Pulsation is generated in the fuel chamber when the high-pressure fuel pump is driven as described above.

In such a high-pressure fuel pump, a damper body for reducing pulsation generated in the fuel chamber is built in the fuel chamber. For example, in Patent Citation 1, two disc-shaped damper bodies, each of which is adapted so that a space between two diaphragms is filled with gas, are disposed in a fuel chamber. Since each damper body includes a deformable-action portion at the central portion thereof and the deformable-action portions are elastically deformed by fuel pressure accompanied by pulsation, the volume of the fuel chamber can be changed and pulsation is reduced.

CITATION LIST

Patent Literature

Patent Citation 1: JP 2007-218264 A (page 7, FIG. 4)

SUMMARY OF INVENTION

Technical Problem

In Patent Citation 1, the fuel chamber of the high-pressure fuel pump is formed as a space hermetically sealed from the outside by a device body and a cup-shaped cover member surrounding a part of the device body, an elastic member is disposed between the two damper bodies, and the two damper bodies are pushed against the device body and the cover member by the elastic member, so that the two damper bodies can be installed not to be moved in the fuel chamber. However, as work for installing the two damper bodies and the elastic member disclosed in Patent Citation 1 in the fuel chamber, there is an aspect where the lower damper body is installed on the device body first, the elastic member is installed on the damper body, the upper damper body is then placed on the elastic member, and the upper damper body is pushed toward the lower damper body when the cover member is finally fixed to the device body. That is, since work for sequentially positioning and stacking the two separate damper bodies and the elastic member on the device body is required in Patent Citation 1, there is a problem in that work for installing these damper bodies is inconvenient.

The present invention has been made in consideration of such a problem, and an object of the invention is to provide a damper unit that allows a plurality of damper bodies to be installed by simple work.

Solution to Problem

In order to solve the above-mentioned problem, a damper unit according to the present invention includes at least two damper bodies installed in a housing space so as to be stacked and including hermetically sealed spaces therein; an elastic member that is disposed between the damper bodies, and a stopper that is installed across outer peripheral edge portions of the damper bodies positioned at both ends.

According to the aforesaid characteristic, the plurality of stacked damper bodies, the elastic member, and the stopper are integrally unitized by the biasing force of the elastic member that is disposed between the damper bodies and the stopper that is installed across the outer peripheral edge portions of the damper bodies positioned at both ends. Accordingly, it is possible to complete the installation of the plurality of damper bodies in the housing space with simple work merely by disposing the unitized damper unit.

It may be preferable that the stopper includes a plurality of connector portions which are installed across the outer peripheral edge portions of the damper bodies positioned at both ends and which are spaced apart from each other in a circumferential direction of the damper bodies. According to this configuration, the plurality of stacked damper bodies can be unitized with no inclination by the plurality of connector portions that are arranged in the circumferential direction of the damper body. Further, a space formed between the damper bodies and the housing space are made to communicate with each other between the connector portions, so that the pulsation-suppressing functions of the damper bodies can be sufficiently ensured.

It may be preferable that the plurality of connector portions are integrally connected by an annular member surrounding a deformable-action portion of one of the damper bodies. According to this configuration, not only the damper unit is easily assembled but also the positions of the plurality of connector portions in the circumferential direction are not shifted, so that the plurality of stacked damper bodies can be unitized with no inclination.

It may be preferable that the damper body includes a contact portion that is provided at the outer peripheral edge portion and is brought into contact with an inner surface of the annular member or inner surfaces of the connector portions. According to this configuration, the contact portion of the outer peripheral edge portion of one damper body of the damper bodies positioned at both ends is in contact with the inner surface of the annular member and the contact portion of the outer peripheral edge portion of the other damper body is in contact with the inner surfaces of the connector portions, so that the relative movement of the damper bodies in a radial direction is prevented. Accordingly, the damper bodies positioned at both ends can be aligned with each other and the plurality of damper bodies can be installed at appropriate positions.

It may be preferable that a concave portion is formed on the outer peripheral edge portion of the damper body, and the stopper includes convex portions that are locked to the concave portion. According to this configuration, since the convex portions of the stopper are locked to the concave portion of the damper body, the relative movement of the damper body and the stopper in the radial direction is restricted. Accordingly, the integration of the damper unit can be improved.

It may be preferable that each of the connector portions of the stopper includes a locking piece portion that is brought into contact with the outer peripheral edge portion of the damper body in an axial direction and an extending portion that extends across the damper bodies positioned at both ends, an inner peripheral side of the extending portion is disposed closer to an outer peripheral side than a welded portion of the outer peripheral edge portion of the damper body, and the concave portion formed on the damper body is positioned closer to an inner peripheral side than the welded portion of the outer peripheral edge portion of the damper body. According to this configuration, the welded portion is protected by the extending portions that are positioned on the outer peripheral side of the welded portion of the diaphragm, the extending portions are not in contact with the welded portion, and the pulsation-suppressing functions of the damper bodies can be maintained.

It may be preferable that each of the connector portions includes another locking piece portion, the two locking portions extending toward an inner peripheral side of the damper body to face the outer peripheral edge portion of the damper body in a direction perpendicular to the outer peripheral edge portion, and the locking piece portions and the extending portion form a U shape. According to this configuration, since the respective locking piece portions are locked to the outer peripheral edge portion of the damper body at two positions in the circumferential direction, an alignment action can be further improved. Further, since the locking piece portions face the outer peripheral edge portion of the damper body in a direction perpendicular to the outer peripheral edge portion and form a U shape together with the extending portion, the strength of each connector portion in a direction where the connector portion is in contact with the damper body is high. Accordingly, the shape of the damper unit can be stably kept.

It may be preferable that restriction part for restricting the movement of the elastic member in a radial direction is formed on the damper bodies. According to this configuration, the central axes of the plurality of damper bodies and the elastic member can coincide with each other, so that the plurality of damper bodies can be unitized with no inclination.

DESCRIPTION OF EMBODIMENTS

A mode for implementing a damper unit according to the present invention will be described below on the basis of an embodiment.

Embodiment

A damper unit according to an embodiment will be described with reference to FIGS. 1 to 8.

Figure 1:
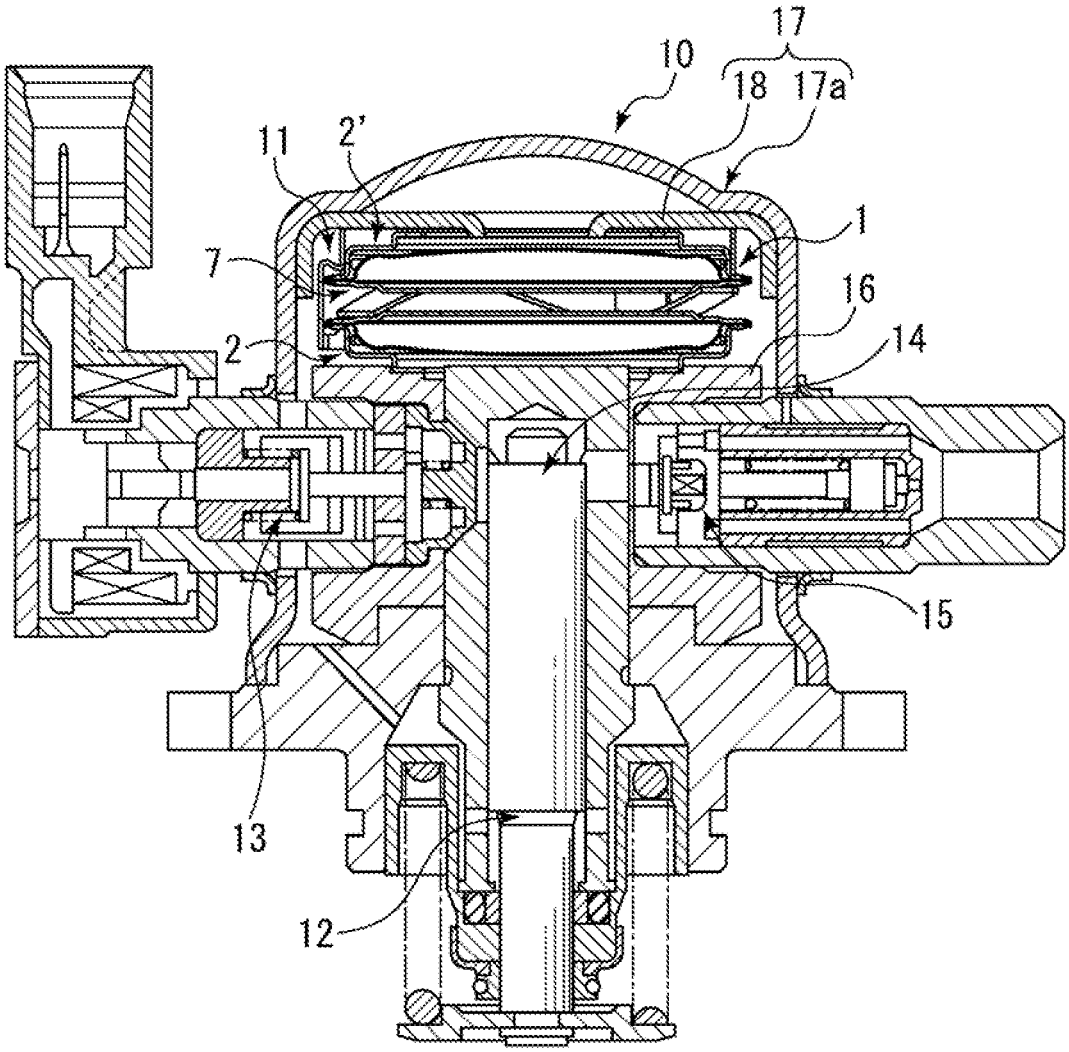
FIG. 1 is a cross-sectional view of a high-pressure fuel pump in which a damper unit according to an embodiment of the present invention is built.

As illustrated in FIG. 1, the damper unit 1 according to the present embodiment is built in a high-pressure fuel pump 10 for pumping fuel, which is supplied from a fuel tank through a fuel inlet (not illustrated), toward an injector. The high-pressure fuel pump 10 pressurizes and discharges fuel by the reciprocation of a plunger 12 that is driven by the rotation of a cam shaft (not illustrated) of an internal-combustion engine.

As a mechanism for pressurizing and discharging fuel in the high-pressure fuel pump 10, an intake stroke for opening an intake valve 13 and taking in fuel to a pressurizing chamber 14 from a fuel chamber 11 formed on a fuel inlet side, when the plunger 12 is moved down, is performed first. Then, an amount adjustment stroke for returning a part of the fuel of the pressurizing chamber 14 to the fuel chamber 11, when the plunger 12 is moved up, is performed, and a pressurization stroke for pressurizing fuel, when the plunger 12 is further moved up after the intake valve 13 is closed, is performed.

As described above, the high-pressure fuel pump 10 repeats a cycle that includes the intake stroke, the amount adjustment stroke, and the pressurization stroke, to pressurize fuel, to open a discharge valve 15, and to discharge the fuel toward the injector. In this case, pulsation in which high pressure and low pressure are repeated is generated in the fuel chamber 11. The damper unit 1 is used to reduce such pulsation that is generated in the fuel chamber 11 of the high-pressure fuel pump 10.

Figure 2:
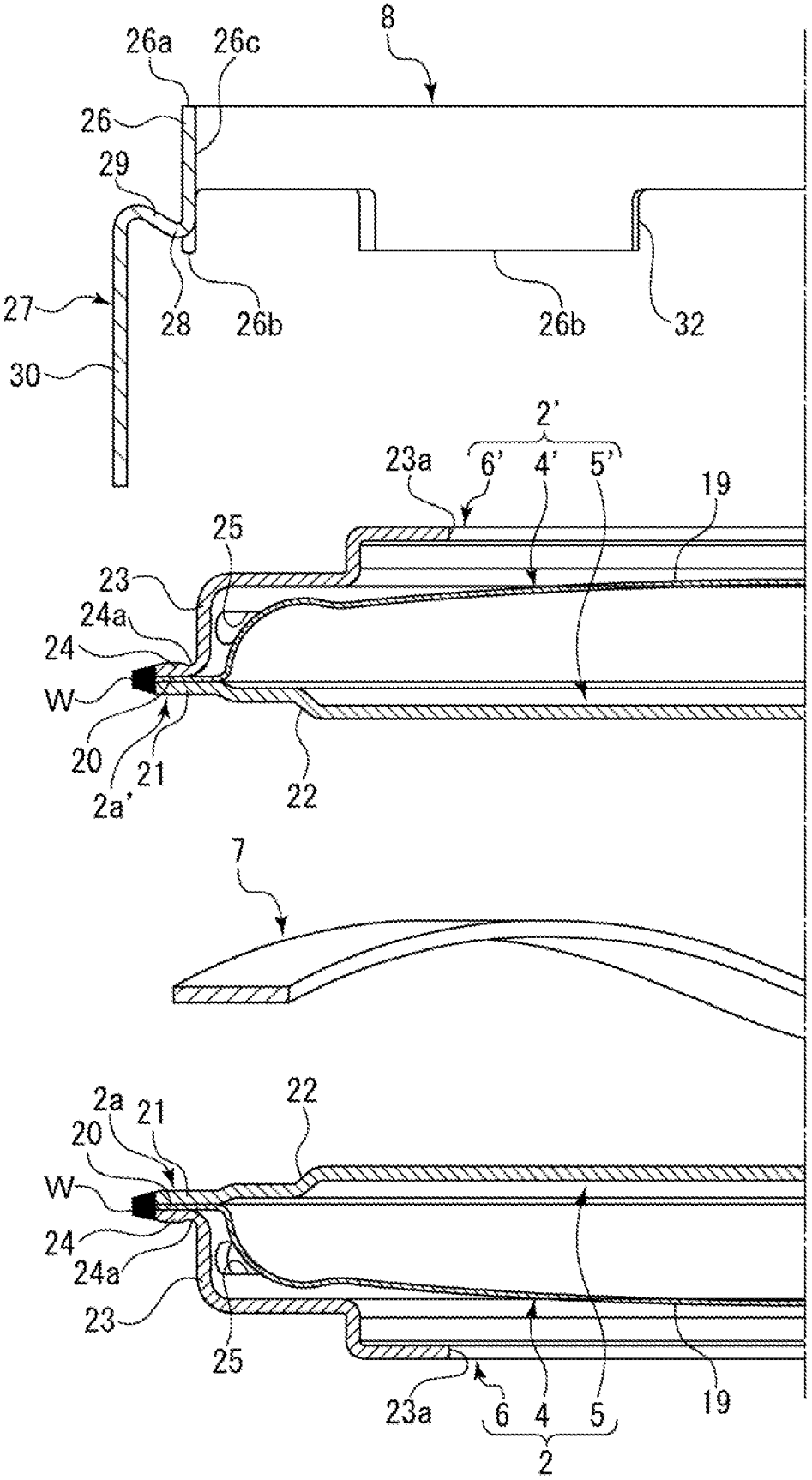
FIG. 2 is an exploded cross-sectional view showing components forming the damper unit in the embodiment.

As illustrated in FIG. 2, the damper unit 1 includes: a damper body 2 that includes a diaphragm 4, a plate 5, and a stay member 6; a damper body 2' that is disposed symmetrically with the damper body 2 in an axial direction; a wave spring 7 as an elastic member that is disposed between the damper bodies 2 and 2'; and a stopper 8.

The diaphragm 4 is formed in the shape of a dish to have a uniform thickness as a whole by the pressing of a metal plate. A deformable-action portion 19 bulging in the axial direction is formed on the radially central side of the diaphragm 4, and an outer peripheral edge portion 20 having the shape of an annular flat plate is formed on the outer peripheral side of the deformable-action portion 19 to extend radially outward from the deformable-action portion 19. The diaphragm 4 is adapted so that the deformable-action portion 19 is easily deformed in the axial direction by fluid pressure in the fuel chamber 11.

The plate 5 is formed in the shape of a flat plate by the pressing of a metal plate that is thicker than the metal plate forming the diaphragm 4. The inner peripheral side of the plate 5 is formed in a planar shape having steps, and an outer peripheral edge portion 21 overlapping with the outer peripheral edge portion 20 of the diaphragm 4 is formed on the outer peripheral side of the plate 5. The plate 5 is formed in the shape of a flat plate having a thickness, and is adapted to be difficult to be deformed by fluid pressure in the fuel chamber 11. Further, since an annular convex portion 22, also referred to as restriction part formed to have a diameter slightly smaller than the inner diameter of the wave spring 7 is formed on the inside of the outer peripheral edge portion 21, the movement of the wave spring 7 in a radial direction is restricted when the diaphragm 4 and the wave spring 7 are assembled with each other.

As illustrated in FIG. 2, the stay member 6 includes an annular cylindrical portion 23 which surrounds the deformable-action portion 19 of the diaphragm 4 in a circumferential direction and in which a through-hole penetrating itself in the axial direction is formed, and an outer peripheral edge portion 24 overlapping with the outer peripheral edge portion 21 of the plate 5 is formed on the outer peripheral side of the cylindrical portion 23. Further, a plurality of through-holes 25 are formed at the cylindrical portion 23 to be spaced apart from each other in the circumferential direction. Furthermore, an annular concave portion 24*a* is formed on the surface of the outer peripheral edge portion 24 of the stay member 6 opposite to the outer peripheral edge portion 21 of the plate 5.

As illustrated in FIG. 2, the outer peripheral edge portion 20 of the diaphragm 4, the outer peripheral edge portion 21 of the plate 5, and the outer peripheral edge portion 24 of the stay member 6 are fixed to each other in the circumferential direction by welding, and form an outer peripheral edge portion 2*a* of the damper body 2. A welded portion W is positioned at the outermost edge of the outer peripheral edge portion 2*a*. The outer peripheral edge portion 20 of the diaphragm 4 and the outer peripheral edge portion 21 of the plate 5 are fixed to each other by welding, so that the inside of the damper body 2 is hermetically sealed. Further, since the diaphragm 4, the plate 5, and the stay member 6 are integrally fixed, not only it is easy to assemble the damper unit 1 but also it is possible to prevent the diaphragm 4 from being broken due to a collision between the diaphragm 4 and the cylindrical portion 23 of the stay member 6.

Figure 5:
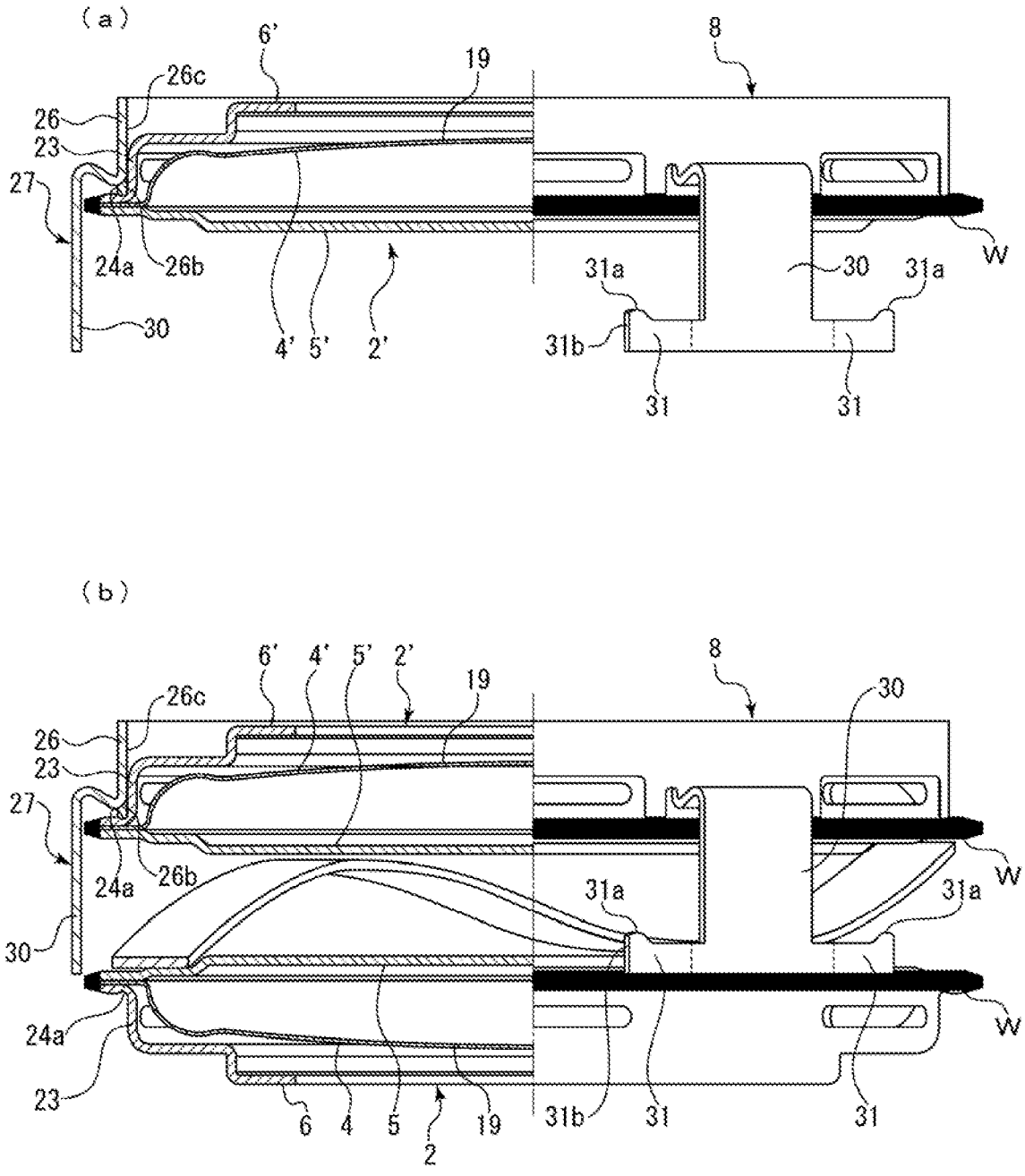
FIG. 5A is a partial cross-sectional view illustrating a state where one damper body is temporarily fixed to a stopper in the embodiment.
FIG. 5B is a partial cross-sectional view illustrating s state where a wave spring and the other damper body are stacked on one damper body in the embodiment.

As illustrated in FIGS. 2 and 5, the wave spring 7 is formed by the deformation of an annular plate-like steel wire in a wave shape. Accordingly, the wave spring 7 is adapted to be capable of generating a biasing force in the axial direction.

Figure 3:
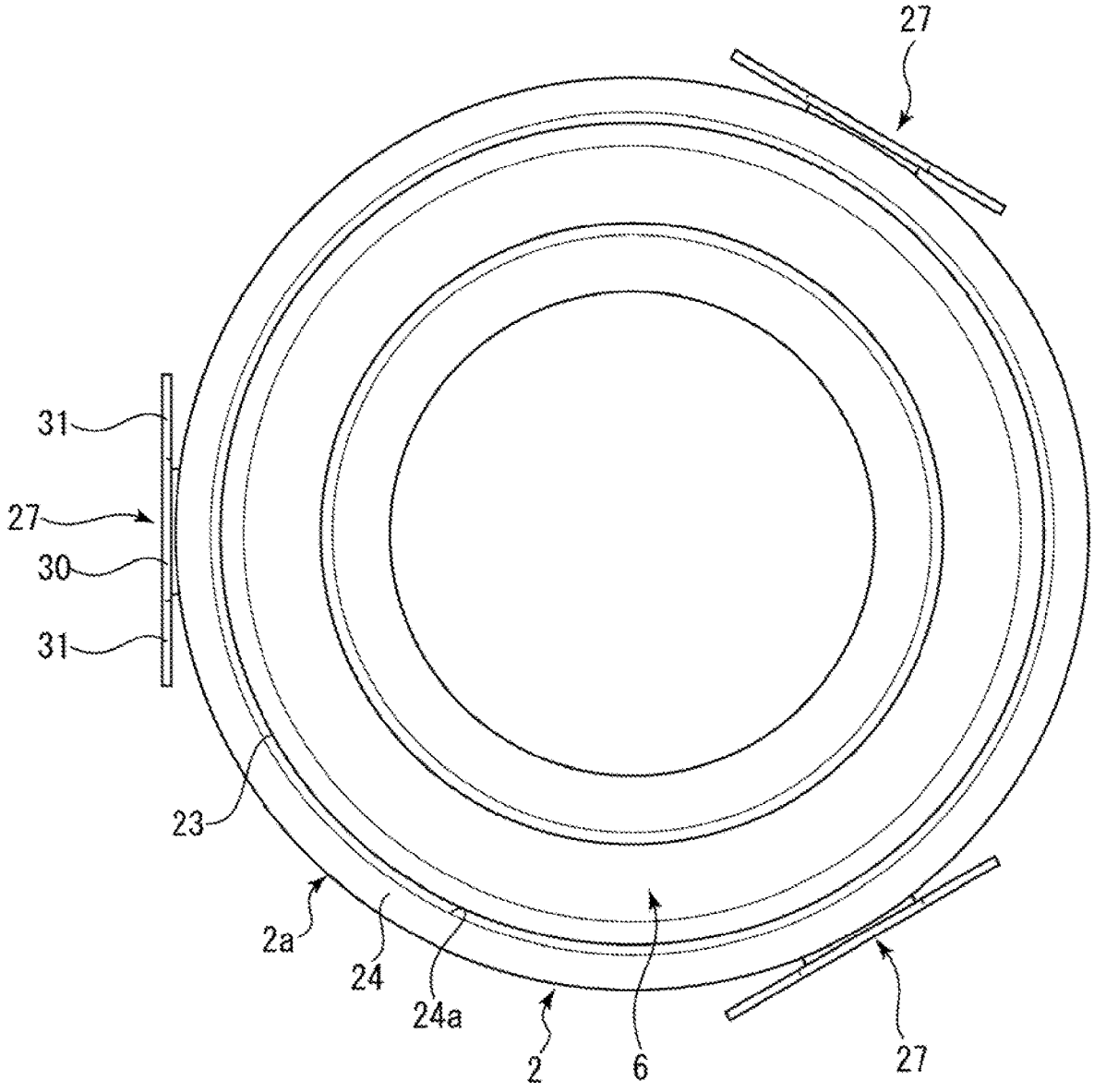
FIG. 3 is a plan view illustrating the arrangement relationship of locking portions relative to a damper body in the embodiment.

As illustrated in FIGS. 2 and 3, the stopper 8 includes an annular cylindrical portion (also referred to as an annular member) 26 which concentrically and circumferentially surrounds an annular cylindrical portion 23 of the other stay member 6' on the outer peripheral side and in which a through-hole penetrating itself in the axial direction is formed, and three locking portions 27 are regularly arranged to be spaced apart from each other in the circumferential direction of the cylindrical portion 26.

The locking portions 27 protrude radially outward from an end portion 26*b* of the cylindrical portion 26 in the axial direction, and extend in the axial direction. In detail, the locking portions 27 are formed by cutout from the same metal sheet as the cylindrical portion 26, and a cut-out piece, which starts to extend from the inside in the axial direction (i.e., on a side of the end portion 26*a*), is bent radially outward from the end portion 26*b* of the cylindrical portion 26 in the axial direction and is then folded down to be formed in an L shape.

Each locking portion 27 mainly includes: a bent portion 28 that is formed to be bent radially outward at a boundary between the cut-out piece, which forms the cylindrical portion 26, and itself; a connecting portion 29 that extends obliquely radially outward from the bent portion 28 and extends in a planar shape; an extending portion 30 that is bent from an end portion of the connecting portion 29 and extends in parallel to the cylindrical portion 26; and locking piece portions 31 and 31 that extend to the left and right from the free end portion of the extending portion 30.

Figure 4:
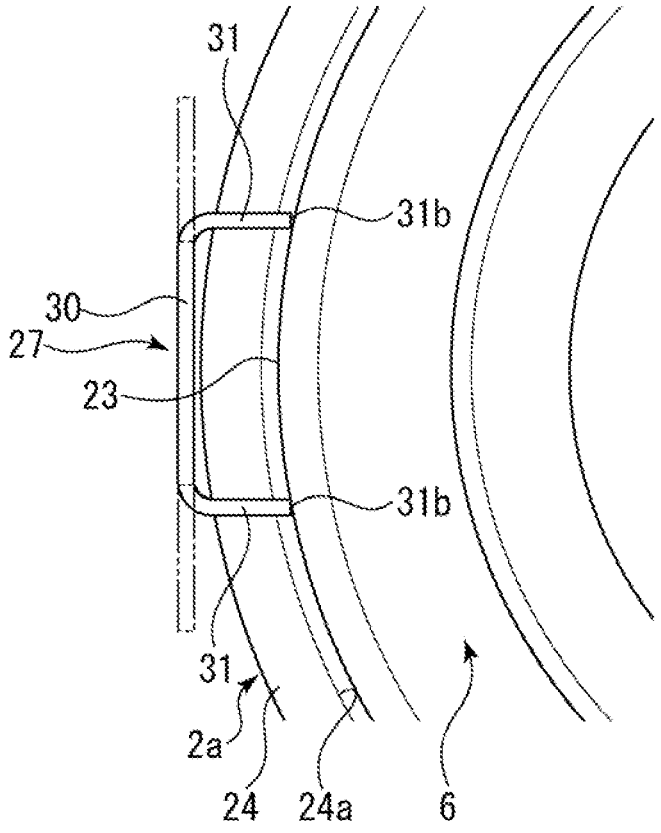
FIG. 4 is a partially enlarged plan view illustrating the aspect of the bending deformation of locking piece portions in the embodiment.

As illustrated in FIG. 5, the locking piece portions 31 and 31 are formed in the shape of a flat plate and include protruding portions (convex portions) 31*a* and 31*a* formed at upper ends of end portions thereof. As illustrated in FIG. 5, the locking piece portions 31 and 31 are deformed to be bent inward at the boundary portions between the extending portion 30 and themselves (toward the inner peripheral side at portions illustrated in FIG. 5A by a broken line) at an angle of about 90°, so that the locking piece portions 31 and 31 deformed to be bent toward the inner peripheral side of the damper body 2 form a U shape together with the extending portion 30. Further, as illustrated in FIGS. 4 and 6B, in a state where the locking piece portions 31 and 31 are bent, the locking piece portions 31 and 31 face the outer peripheral edge portion 2*a* of the damper body 2 in a direction perpendicular to the outer peripheral edge portion 2*a* and the protruding portions 31*a* and 31*a* formed at the locking piece portions 31 and 31 are locked to the annular concave portion 24*a* of the stay member 6. As a result, the relative movement of the stopper 8 and the damper body 2 in the radial direction is restricted.

Furthermore, the end portion 26*b* of the cylindrical portion 26 is locked to the annular concave portion 24*a* of the stay member 6' as illustrated in FIG. 5, so that the relative movement of the stopper 8 and the damper body 2' in the radial direction is restricted. As described above, the locking portions 27 are positioned so that the outer peripheral edge portions 2*a* and 2*a*' of the damper bodies 2 and 2' are sandwiched between the locking piece portions 31 and 31 and the end portion 26*b* of the cylindrical portion 26 in the axial direction, and the locking piece portions 31 and 31, and the end portion 26*b* of the cylindrical portion 26, and the extending portion 30, which connects the locking piece portions 31 and 31 to the end portion 26*b*, form a connector portion that is installed across the outer peripheral edge portions 2*a* and 2*a*' of the damper bodies 2 and 2' and restricts the movement of the damper bodies 2 and 2' in a direction where the damper bodies 2 and 2' are spaced apart from each other.

Moreover, a plurality of notched openings 32 are formed at the cylindrical portion 26 of the stopper 8 to be spaced apart from each other in the circumferential direction in a phase corresponding to the through-holes 25 formed at the cylindrical portion 23 of the stay member 6'.

Figure 6:
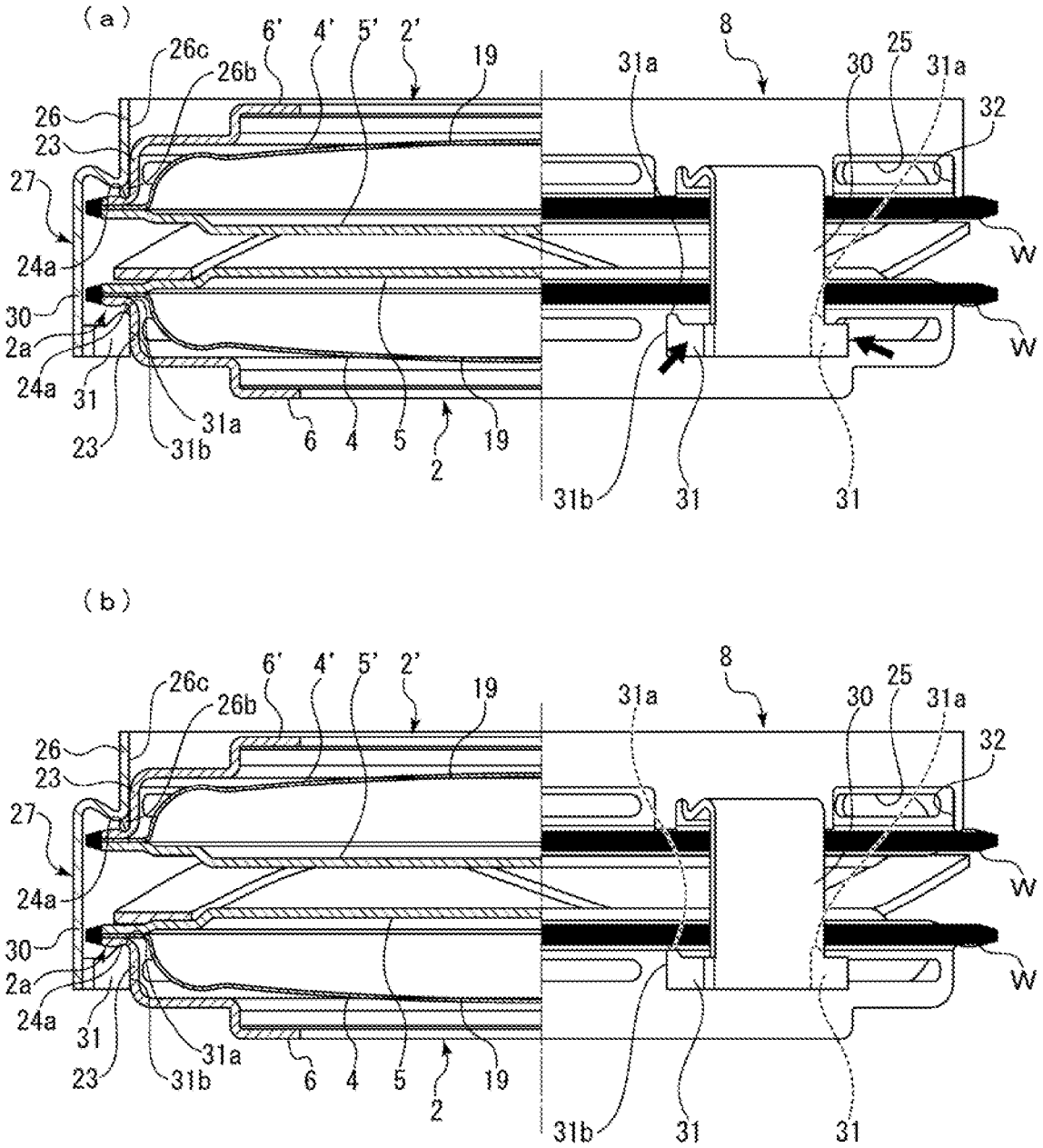
FIG. 6A is a partial cross-sectional view illustrating a state where the damper bodies are made close to each other and the locking piece portions are deformed to be bent in the embodiment.
FIG. 6B is a partial cross-sectional view illustrating a state where the damper bodies are spaced apart from each other by the biasing force of the wave spring and the assembly of the damper unit is completed in the embodiment.

Next, a procedure for assembling the damper unit 1 will be described with reference to FIGS. 5 and 6. First, as illustrated in FIG. 5A, the cylindrical portion 23 of the stay member 6' of one damper body 2' is fitted into the cylindrical portion 26 of the stopper 8 so that the damper body 2' and the stopper 8 are temporarily fixed to each other. In this case, the end portion 26*b* of the cylindrical portion 26 is disposed in the concave portion 24*a* formed on the outer peripheral edge portion 24 of the stay member 6'. Then, as illustrated in FIG. 5B, the wave spring 7 and the other damper body 2 are disposed to overlap with the damper body 2'.

After that, as illustrated in FIG. 6A, the stopper 8 is pressed in the axial direction to make the damper bodies 2' and 2 be close to each other, and the locking piece portions 31 and 31 are deformed to be bent toward the inner peripheral side in a state where the wave spring 7 is compressed by the plate 5' of the damper body 2' and the plate 5 of the damper body 2.

Since the locking piece portions 31 and 31 are deformed to be bent toward the inner peripheral side, the damper bodies 2' and 2 are moved by the biasing force of the wave spring 7 in a direction where the damper bodies 2' and 2 are spaced apart from each other and the protruding portions 31*a* and 31*a* of the locking piece portions 31 and 31 are locked to the concave portion 24*a* formed on the outer peripheral edge portion 24 of the stay member 6 from the outside in the axial direction (that is, the cylindrical portion 23) as illustrated in FIG. 6B. Accordingly, the damper bodies 2, and 2', the wave spring 7, and the stopper 8 are integrally unitized, and the assembly of the damper unit 1 is then completed.

One damper body 2' is temporarily fixed to the stopper 8, so that the movement of the damper body 2' in the axial direction is restricted. The outer peripheral edge portion 2*a* of the other damper body 2 is guided by the extending portions 30 of the locking portions 27 of the stopper 8, so that the other damper body 2 can be moved relative to the stopper 8.

Figure 7:
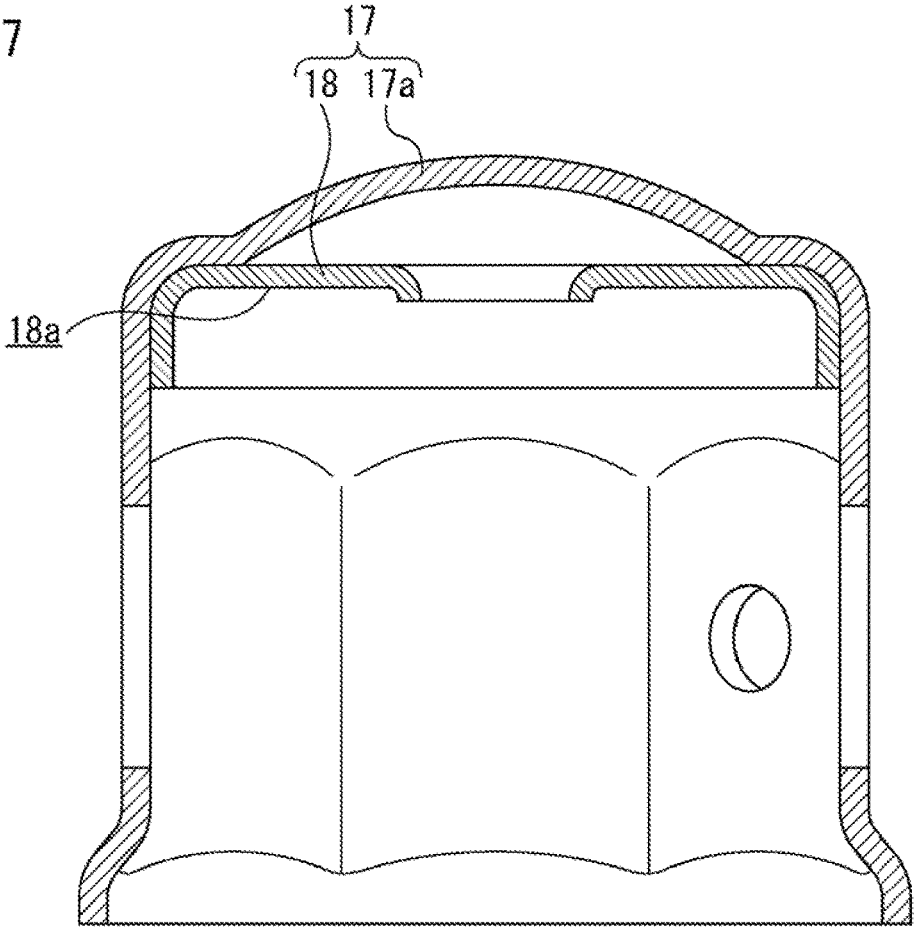
FIG. 7 is an exploded cross-sectional view illustrating a device body and a cover member, which form a housing space and are not yet installed, and the damper unit in the embodiment.
Figure 7:
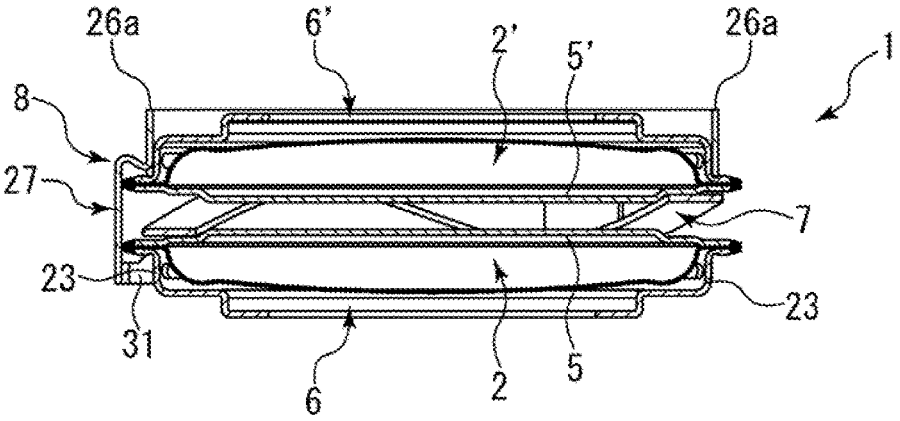
Figure 7:
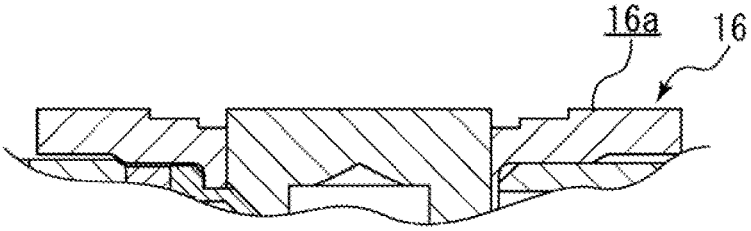

Next, a process for installing the damper unit 1 will be described with reference to FIGS. 7 and 8. The fuel chamber 11 of the high-pressure fuel pump 10 includes a device body 16 and a cover member 17 that surrounds a part of the device body 16. A damper stopper 18 with which the outer peripheral edge of the damper unit 1 and an end portion of the damper unit 1 in the axial direction can be in contact is mounted on the inside of the cover member body 17*a* of the cover member 17.

The stay member 6 of the damper unit 1 is placed on an end face 16*a* of the device body 16. Next, after the cover member 17 is in contact with the device body 16 from above, the cover member 17 is liquid-tightly fixed. During an operation for making the cover member 17 be in contact with the device body 16, an inner surface 18*a* of the damper stopper 18 of the cover member 17, which is moved to be close to the device body 16, is in contact with the end portion 26*a* of the cylindrical portion 26 of the stopper 8, and the stopper 8 is then pressed with the movement of the cover member 17. Accordingly, the end portion 26*b* of the cylindrical portion 26 of the stopper 8 presses the outer peripheral edge portion 24 of the stay member 6' in a direction toward the device body 16, so that the damper bodies 2 and 2' are made to be close to each other by a reaction force applied from the stay member 6 being in contact with the device body 16.

Figure 8:
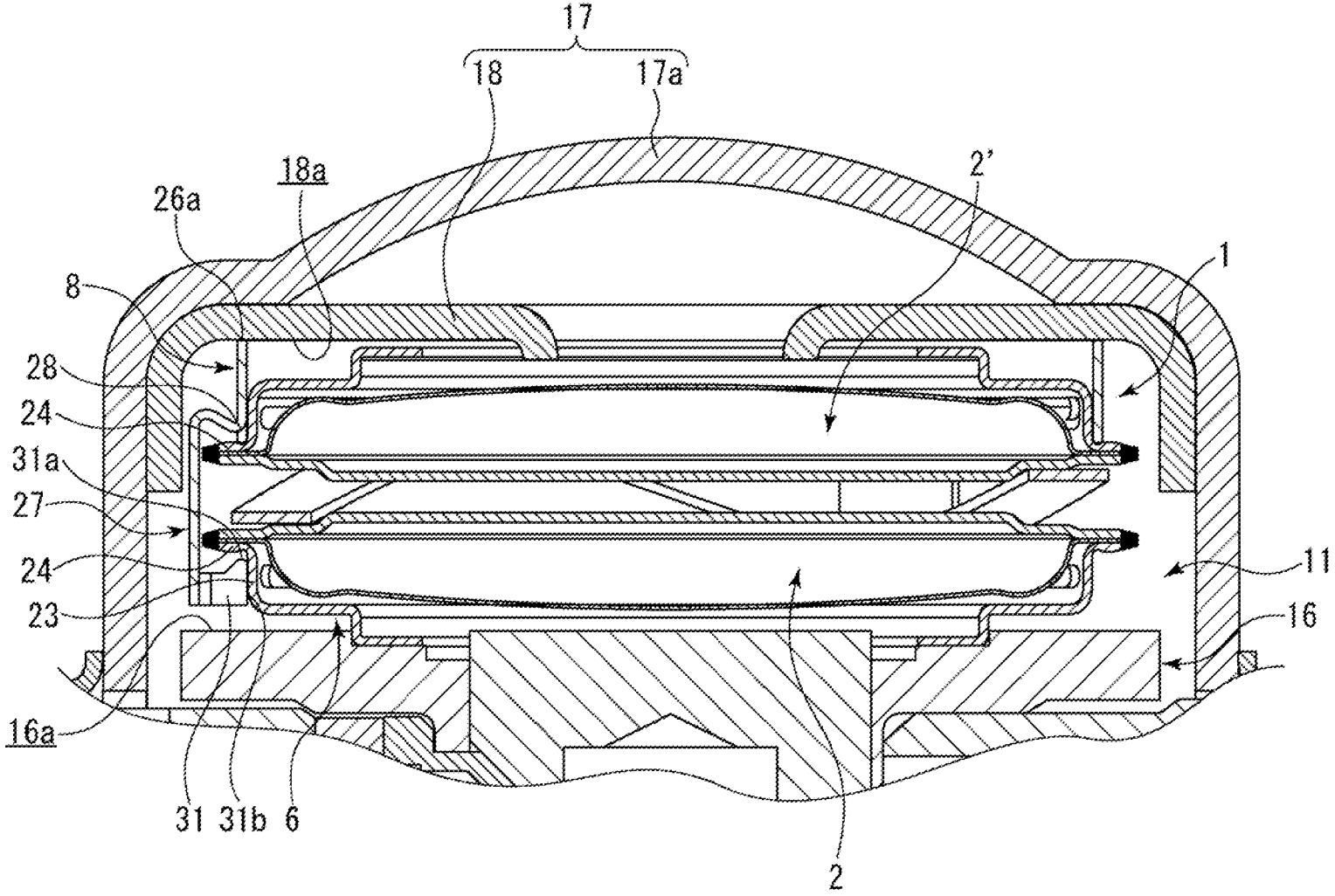
FIG. 8 is a cross-sectional view illustrating a state where the installation of the damper unit in the housing space is completed in the embodiment.

Since the damper bodies 2 and 2' are made to be close to each other, the wave spring 7 is compressed and the outer peripheral edge portion 2*a* of the damper body 2 is spaced apart from the locking piece portions 31 and 31 of the locking portions 27 as illustrated in FIG. 8. In a state where the fixing between the cover member 17 and the device body 16 is completed, the damper bodies 2 and 2' are pushed in a direction where the damper bodies 2 and 2' are spaced apart from each other by the biasing force of the wave spring 7 that is applied in the axial direction. Accordingly, the end portion 26*a* of the cylindrical portion 26 of the stopper 8 forming an annular surface is pressed against the inner surface 18*a* of the damper stopper 18 of the cover member 17 and an end portion 23*a* of the stay member 6 forming an annular surface is pressed against the end face 16*a* of the device body 16 likewise, so that the damper unit 1 is stably held in the fuel chamber 11.

Further, the cylindrical portion 23 of the stay member 6 is in contact with an inner peripheral surface 26*c* of the cylindrical portion 26 of the stopper 8 during installation, so that the relative movement of the damper body 2' and the stopper 8 in the radial direction is restricted. The cylindrical portion 23 of the stay member 6 is in contact with end portions 31*b* of the locking piece portions 31 and 31, so that the movement of the damper body 2 in the radial direction is restricted. That is, the relative movement of the damper bodies 2 and 2' in the radial direction is restricted by the stopper 8.

Next, the pulsation absorption of the damper unit 1, when the damper unit 1 receives fuel pressure accompanied by pulsation in which high pressure and low pressure are repeated, will be described. The hermetically sealed spaces formed in the damper bodies 2 and 2' are filled with gas that is formed of argon, helium, and the like and has predetermined pressure. Meanwhile, the amount of change in the volume of each of the damper bodies 2 and 2' is adjusted using the pressure of gas to be filled in each of the damper bodies 2 and 2', so that desired pulsation absorption performance can be obtained.

When fuel pressure accompanied by pulsation is changed to high pressure from low pressure and fuel pressure generated from the fuel chamber 11 is applied to the diaphragms 4 and 4', the deformable-action portions 19 are crushed inward and the gas filled in the damper bodies 2 and 2' is compressed. Since the deformable-action portions 19 are elastically deformed by fuel pressure accompanied by pulsation, the volume of the fuel chamber 11 can be changed and pulsation is reduced.

Further, since the movement of the wave spring 7 in the radial direction is restricted by the convex portion 22 which is formed on the plate 5 and which is also referred to as restriction part, the central axes of the damper bodies 2 and 2' and the wave spring 7 can coincide with each other and the damper bodies 2 and 2' can be uniformly pressed in a direction where the damper bodies 2 and 2' are spaced apart from each other. Accordingly, the plurality of damper bodies 2 and 2' can be unitized with no inclination.

Furthermore, since the stay member 6' and the stopper 8 are assembled with each other so that the through-holes 25 formed at the cylindrical portion 23 of the stay member 6' and the openings 32 formed at the cylindrical portion 26 of the stopper 8 overlap with each other, the outside of the stay member 6', that is, the interior space of the fuel chamber 11 and the inside of the stay member 6', that is, a space around the damper body 2' communicate with each other through the through-holes 25 and the openings 32.

Further, since a space around the damper body 2 communicates with the outside of the stay member 6 through the through-holes 25 of the stay member 6, flow channels, which connect the space around the damper body 2 to the outside of the stay member 6, are not blocked when each locking portion 27 is disposed between the adjacent through-holes 25 of the stay member 6.

The members to be in contact with the cover member 17 and the device body 16 are formed in an annular shape as described above. Accordingly, while the damper unit 1 can be stably held in the fuel chamber 11, fuel pressure, which is accompanied by pulsation in which high pressure and low pressure generated in the fuel chamber 11 are repeated, can be made to be directly applied to the damper bodies 2 and 2', so that sufficient pulsation reduction performance can be ensured.

As described above, the plurality of stacked damper bodies 2 and 2', the wave spring 7, and the stopper 8 are integrally unitized by the biasing force of the wave spring 7 that is disposed between the damper bodies 2 and 2' and the stopper 8 that is installed across the outer peripheral edge portions 2*a* and 2*a'* of the damper bodies 2 and 2'. Accordingly, it is possible to simply install the plurality of damper bodies 2 and 2' in the fuel chamber 11 merely by disposing the unitized damper unit 1. Further, since the installation of the plurality of damper bodies 2 and 2' in the fuel chamber 11 can be quickly completed, it is possible to prevent foreign materials from entering the fuel chamber 11.

Furthermore, since the stopper 8 includes a plurality of connector portions that are installed across the outer peripheral edge portions 2*a* and 2*a'* of the damper bodies 2 and 2' and are spaced apart from each other in the circumferential direction of the damper bodies 2 and 2', the plurality of stacked damper bodies 2 and 2' can be unitized with no inclination. Moreover, the space formed between the damper bodies 2 and 2' and the interior space of the fuel chamber 11 are made to communicate with each other between the locking portions 27 forming the connector portions, so that the pulsation-suppressing functions of the damper bodies 2 and 2' can be sufficiently ensured. In addition, since these locking portions 27 are formed to protrude from the cylindrical portion 26 to the outer peripheral side, the locking portions 27 come into contact with the cover member 17 prior to the outer peripheral edge portions 2*a* and 2*a'* of the damper bodies 2 and 2' when the damper unit 1 is moved in the radial direction due to vibration or the like. Accordingly, the breakage of the damper bodies 2 and 2' can be effectively prevented.

Further, since the stopper 8 is adapted so that the plurality of connector portions are integrally connected by the annular member forming the cylindrical portion 26, not only the damper unit 1 is easily assembled but also the positions of the plurality of connector portions in the circumferential direction are regulated, so that the plurality of stacked damper bodies 2 and 2' can be unitized with no inclination.

Furthermore, the damper bodies 2 and 2' include the stay members 6' and 6 that extend in the axial direction on the outer peripheral sides of the deformable-action portions of the diaphragms 4 and 4', and the inner peripheral surface 26*c* of the cylindrical portion 26 of the stopper 8 and the end portions 31*b* of the locking piece portions 31 are in contact with the cylindrical portions 23 of the stay members 6' and 6, respectively, so that the relative movement of the damper bodies 2 and 2' in the radial direction is prevented. Accordingly, the damper bodies 2 and 2' can be aligned with each other and can be installed at appropriate positions in the fuel chamber 11, so that an appropriate pulsation-suppressing function can be fulfilled. In addition, since the inner peripheral surface 26*c* of the cylindrical portion 26 of the stopper 8 and the end portions 31*b* of the locking piece portions 31 are adapted not to be in direct contact with the diaphragms 4' and 4, the breakage of the diaphragms 4' and 4 can be prevented.

Further, since the inner peripheral sides of the extending portions 30 of the stopper 8 are spaced apart from the welded portion W of the outer peripheral edge portion 2*a* of the damper body 2 to the outer peripheral side and the concave portion 24*a* formed on the damper body 2 is positioned closer to the inner peripheral side than the welded portion W of the damper body 2, the extending portions 30 come into contact with the cover member 17 prior to the diaphragm 4 and prevent the welded portion W, which is positioned at the outermost edge of the diaphragm 4, from coming into contact with the cover member 17 and the stopper 8 can be adapted not to come into contact with the welded portion W. Accordingly, damage to the welded portion W can be reliably prevented and the pulsation-suppressing function of the damper body can be maintained.

Furthermore, since two locking piece portions 31 and 31 extend toward the inner peripheral side of the damper body 2 to face the outer peripheral edge portion 2*a* of the damper body 2 in a direction perpendicular to the outer peripheral edge portion 2*a* and the locking piece portions 31 and 31 are locked to the outer peripheral edge portion 2*a* of the damper body 2 at a plurality of positions in the circumferential direction, an alignment action can be further improved. Moreover, since the locking piece portions 31 and 31 face the outer peripheral edge portion 2*a* of the damper body 2 in a direction perpendicular to the outer peripheral edge portion 2*a* and form a U shape together with the extending portion 30, the strength of each locking portion in a direction where the locking portion is in contact with the damper body 2 is high. Accordingly, the shape of the damper unit 1 can be stably kept.

Further, the concave portion 24*a* is formed on the outer peripheral edge portion 2*a'* of the damper body 2', the end portion 26*b* of the cylindrical portion 26 is adapted to be locked to the concave portion 24*a*, and the protruding portions 31*a* and 31*a* formed at the locking piece portions 31 and 31 are adapted to be locked to the concave portion 24*a* of the outer peripheral edge portion 2*a* of the damper body 2. Accordingly, since the relative movement of the damper bodies 2 and 2' and the stopper 8 in the radial direction is restricted, the integration of the damper unit 1 can be improved.

The embodiment of the present invention has been described above with reference to the drawings, but specific configuration is not limited to the embodiment. Even though modifications or additions are provided without departing from the scope of the invention, the modifications or additions are included in the present invention.

For example, in the embodiment, each connector portion of the stopper 8 includes the locking piece portions 31 and 31, the end portion 26*b* of the cylindrical portion 26, and the extending portion 30, which connects the locking piece portions 31 and 31 to the end portion 26*b*, and is adapted to be installed across the outer peripheral edge portions 2*a* and 2*a'* of the damper bodies 2 and 2'. However, the connector portion is not limited thereto, and, for example, instead of the end portion 26*b* of the cylindrical portion 26, the bent portion 28 of the locking portion 27 may be adapted to be in contact with the outer peripheral edge portion 2*a'* of the damper body 2'.

Further, each of a plurality of members functioning as connector portions may include portions that are in contact with the outer peripheral edge portions 2*a* and 2*a'* of the damper bodies 2 and 2' as with the end portion 26*b* of the cylindrical portion 26 and the locking piece portions 31 and 31, and a portion that is similar to the extending portion 30 connecting the end portion 26*b* to the locking piece portions 31 and 31; the plurality of members functioning as connector portions may be arranged in the circumferential direction of the damper body 2; and a stopper for unitizing the damper bodies 2 and 2' and the wave spring 7 as an integrated damper unit 1 may be formed of the plurality of arranged members functioning as connector portions. In this case, an annular member integrally connecting the connector portions as with the cylindrical portion 26 may be omitted. Furthermore, the connector portions may be formed separately from the annular member, and may be fixed using fixing means, such as screws, to form a stopper.

Further, as long as the stopper 8 is adapted so that a plurality of locking portions 27 are arranged in the circumferential direction, each locking portion 27 may be provided with only one locking piece portion 31.

Furthermore, the stopper 8, which is adapted so that three locking portions 27 are arranged to be spaced apart from each other in the circumferential direction, has been described in the embodiment, but the stopper 8 is not limited thereto. For example, four or more locking portions 27 may be arranged to be spaced apart from each other or, conversely, a locking portion may be formed over the entire circumference. Meanwhile, when a locking portion is formed over the entire circumference, it is preferable that holes penetrating the locking portion are formed at portions of the locking portion corresponding to the extending portions to allow the space formed between the damper bodies 2 and 2' and the interior space of the fuel chamber 11 to communicate with each other and the pulsation-suppressing functions of the damper bodies 2 and 2' are thus sufficiently ensured.

Further, a component for restricting the relative movement of the damper bodies 2 and 2' and the stopper 8 in the radial direction is not limited to the concave portion 24*a* formed on the outer peripheral edge portion 2*a* of the damper body 2 of the embodiment, and may be, for example, the end portion 26*b* of the cylindrical portion 26 or a convex portion, to which the protruding portions 31*a* and 31*a* formed at the locking piece portions 31 and 31 are to be locked, instead of the concave portion 24*a* of the outer peripheral edge portion 2*a* of the damper body 2. Furthermore, components of the stopper 8 to be locked to the concave portions 24*a* are not limited to the protruding portions 31*a* and the end portion 26*b* of the cylindrical portion 26. For example, a plurality of convex portions may be formed at the end portion of the cylindrical portion to be spaced apart from each other in the circumferential direction and may be locked to the concave portion 24*a*; and the concave portion is also not limited to a shape continuous in the circumferential direction, and concave portions may be formed at positions, which correspond to the convex portions, to be spaced apart from each other.

Further, the damper unit 1 according to the embodiment includes two stacked damper bodies 2 and 2', but is not limited thereto. For example, the damper unit 1 may be adapted so that three or more damper bodies are stacked. In this case, the stopper 8 is installed across the damper bodies positioned at both ends.

Furthermore, the damper bodies 2 and 2' may not include the stay members 6 and 6', and the cylindrical portion 26 of the stopper 8 and the locking piece portions 31 and 31 of the locking portions 27 may be in direct contact with the outer peripheral edge portions of the diaphragms 4' and 4, respectively. Meanwhile, when the stay members are omitted, for the restriction of the relative movement of the damper bodies 2 and 2' and the stopper 8 in the radial direction, it is preferable that contact portions to be in contact with the cylindrical portion 26 of the stopper 8 and the locking piece portions 31 and 31 of the locking portions 27 are formed at the outer peripheral edge portions of the diaphragms 4' and 4 not to allow the cylindrical portion 26 of the stopper 8 and the locking piece portions 31 and 31 of the locking portions 27 to be in direct contact with the deformable-action portions 19 of the diaphragms 4' and 4.

Further, the damper bodies 2 and 2' are not limited to structure including the deformable diaphragms 4 and 4' and the plates 5 and 5' that are not easily deformable, and each of the damper bodies 2 and 2' may be formed of, for example, two deformable diaphragms that are symmetrically attached to each other. In this case, biasing means disposed between the damper bodies is adapted to be in contact with the outer peripheral edge portions of the diaphragms avoiding the deformable-action portions of the diaphragms. The biasing means is not limited to a wave spring, and may be formed of, for example, a plurality of coil springs that are arranged in the circumferential direction.

Furthermore, an example, in which the damper unit 1 is disposed and installed in the fuel chamber 11 so that the end portion 26*a* of the cylindrical portion 26 of the stopper 8 is in contact with the inner surface 18*a* of the damper stopper 18 of the cover member 17 and the end portion 23*a* of one stay member 6 is in contact with the end face 16*a* of the device body 16, has been described. However, conversely, the damper unit 1 may be disposed so that one stay member 6 is in contact with the cover member 17 and the stopper 8 is in contact with the device body 16.

Further, configuration where the end portion 26*a* of the cylindrical portion 26 of the stopper 8 is positioned closer to the outside in the axial direction than the end portion 23*a* of the stay member 6' (the end portion 26*a* protrudes from the end portion 23*a* in the axial direction) has been described in the embodiment, but the end portion 23*a* of the stay member 6' may be positioned closer to the outside in the axial direction than the end portion 26*a* of the cylindrical portion 26 of the stopper 8 (the end portion 23*a* protrudes from the end portion 26*a* in the axial direction).

Furthermore, an example where the outer peripheral edge portion 20 of the diaphragm 4, the outer peripheral edge portion 21 of the plate 5, and the outer peripheral edge portion 24 of the stay member 6 are integrally fixed in the circumferential direction by welding has been described in the embodiment, but the invention is not limited thereto. For example, the outer peripheral edge portion 20 of the diaphragm 4 and the outer peripheral edge portion 21 of the plate 5 may be fixed to each other by welding and the outer peripheral edge portion 21 of the plate 5 and the outer peripheral edge portion 24 of the stay member 6 may not be fixed to each other.

Further, one damper body 2 and the other damper body 2' may not have the same shape.

Furthermore, an aspect where the damper unit 1 is provided in the fuel chamber 11 of the high-pressure fuel pump 10 to reduce pulsation in the fuel chamber 11 has been described in the embodiment, but the invention is not limited thereto. For example, the damper unit 1 may be provided on a fuel pipe or the like connected to the high-pressure fuel pump 10 to reduce pulsation.

Further, the restriction part for restricting the movement of the wave spring 7 in the radial direction is not limited to the annular convex portion, and may be convex portions positioned at a plurality of points without being limited to an annular shape or may be an annular concave portion.

Furthermore, the extending portions 30 may be formed in the shape of a circular arc of a circle concentric with the outer peripheral edge portion 2*a* of the damper body 2. According to this, since the outer peripheral sides of the extending portions 30 are in contact with the cover member 17 along the inner peripheral surface of the cover member 17, the damper unit 1 can be disposed at an appropriate position in the fuel chamber 11.

REFERENCE SIGNS LIST

1 Damper unit
2, 2' Damper body
2*a*, 2*a'* Outer peripheral edge portion of damper body
4 Diaphragm
5 Plate
6 Stay member
7 Wave spring
8 Stopper
10 High-pressure fuel pump
11 Fuel chamber
12 Plunger
13 Intake valve
14 Pressurizing chamber
15 Discharge valve
16 Device body
17 Cover member
19 Deformable-action portion
22 Convex portion (restriction part)
23 Cylindrical portion (contact portion)
23*a* End portion (convex portion)
24 Outer peripheral edge portion
24*a* Concave portion
26 Cylindrical portion
26*b* End portion (connector portion)
26*c* Inner peripheral surface
27 Locking portion (connector portion)
30 Extending portion (connector portion)
30*a* Inner peripheral side
31, 31 Locking piece portion (connector portion)
31*b* End portion
31*a*, 31*a* Protruding portion (convex portion)
W Welded portion

The invention claimed is:

1. A damper unit comprising:
at least two damper bodies installed in a housing space so as to be stacked and including hermetically sealed spaces therein;
an elastic member that is disposed between the damper bodies; and
a stopper that is installed across outer peripheral edge portions of the damper bodies positioned at both ends, and
wherein a restriction part for restricting the movement of the elastic member in a radial direction is formed on each damper body.

2. The damper unit according to claim 1,
wherein the stopper includes a plurality of connector portions that are installed across the outer peripheral edge portions of the damper bodies positioned at both ends and that are spaced apart from each other in a circumferential direction of the damper bodies.

3. The damper unit according to claim 2,
wherein the plurality of connector portions are integrally connected by an annular member surrounding a deformable-action portion of one of the damper bodies.

4. The damper unit according to claim 3,
wherein each damper body includes a contact portion that is provided at the outer peripheral edge portion and is brought into contact with an inner surface of the annular member or inner surfaces of the connector portions.

5. The damper unit according to claim 2,
wherein a concave portion is formed on the outer peripheral edge portion of each damper body, and the stopper includes convex portions that are locked to the concave portion.

6. The damper unit according to claim 5,
wherein each of the connector portions of the stopper includes a locking piece portion that is brought into contact with the outer peripheral edge portion of the damper body in an axial direction and an extending portion that extends across the damper bodies positioned at both ends,
an inner peripheral side of the extending portion is disposed closer to an outer peripheral side than a welded portion of the outer peripheral edge portion of each damper body, and
the concave portion formed on each damper body is positioned closer to an inner peripheral side than the welded portion of the outer peripheral edge portion of each said damper body.

7. The damper unit according to claim 6,
wherein each of the connector portions includes another locking piece portion, the two locking portions extending toward an inner peripheral side of each damper body to face the outer peripheral edge portion of each said damper body in a direction perpendicular to the outer peripheral edge portion, and
the locking piece portions and the extending portion form a U shape.

8. A damper unit comprising:
at least two damper bodies installed in a housing space so as to be stacked and including hermetically sealed spaces therein;
an elastic member that is disposed between the damper bodies; and
a stopper that is installed across outer peripheral edge portions of the damper bodies positioned at both ends,
wherein the stopper includes a plurality of connector portions that are installed across the outer peripheral edge portions of the damper bodies positioned at both ends and that are spaced apart from each other in a circumferential direction of the damper bodies,
a concave portion is formed on the outer peripheral edge portion of each damper body,
the stopper includes convex portions that are locked to the concave portion,
each of the connector portions of the stopper includes a locking piece portion that is brought into contact with the outer peripheral edge portion of each damper body in an axial direction and an extending portion that extends across each said damper bodies positioned at both ends,
an inner peripheral side of the extending portion is disposed closer to an outer peripheral side than a welded portion of the outer peripheral edge portion of each damper body, and the concave portion formed on each damper body is positioned closer to an inner peripheral side than the welded portion of the outer peripheral edge portion of each said damper body.

9. The damper unit according to claim 8, wherein the plurality of connector portions are integrally connected by an annular member surrounding a deformable-action portion of one of the damper bodies.

10. The damper unit according to claim 9, wherein each damper body includes a contact portion that is provided at the outer peripheral edge portion and is brought into contact with an inner surface of the annular member or inner surfaces of the connector portions.

11. The damper unit according to claim 10, wherein each of the connector portions includes another locking piece portion, the two locking portions extending toward an inner peripheral side of each damper body to face the outer peripheral edge portion of each said damper body in a direction perpendicular to the outer peripheral edge portion, and the locking piece portions and the extending portion form a U shape.

12. The damper unit according to claim 11, wherein a restriction part for restricting the movement of the elastic member in a radial direction is formed on each damper body.

13. The damper unit according to claim 11, wherein a restriction part for restricting the movement of the elastic member in a radial direction is formed on each damper body.

14. The damper unit according to claim 9, wherein each of the connector portions includes another locking piece portion, the two locking portions extending toward an inner peripheral side of the damper body to face the outer peripheral edge portion of the damper body in a direction perpendicular to the outer peripheral edge portion, and the locking piece portions and the extending portion form a U shape.

15. The damper unit according to claim 14, wherein a restriction part for restricting the movement of the elastic member in a radial direction is formed on each damper body.

16. The damper unit according to claim 9, wherein a restriction part for restricting the movement of the elastic member in a radial direction is formed on each damper body.

17. The damper unit according to claim 8, wherein each of the connector portions includes another locking piece portion, the two locking portions extending toward an inner peripheral side of each damper body to face the outer peripheral edge portion of each said damper body in a direction perpendicular to the outer peripheral edge portion, and the locking piece portions and the extending portion form a U shape.

18. The damper unit according to claim 17, wherein a restriction part for restricting the movement of the elastic member in a radial direction is formed on each damper body.

19. The damper unit according to claim 8, wherein a restriction part for restricting the movement of the elastic member in a radial direction is formed on each damper body.

* * * * *